United States Patent [19]

Ravelli et al.

[11] 4,264,778

[45] Apr. 28, 1981

[54] EXTRACTION FURNACE

[75] Inventors: Santo E. Ravelli; Carlo Bettanini; Stelio Zanier; Margherita Enrici, all of Bolzano, Italy

[73] Assignee: Societa Italiana per il Magnesio e Leghe de Magnesio S.P.A., Bolzano, Italy

[21] Appl. No.: 51,967

[22] Filed: Jun. 25, 1979

[51] Int. Cl.[3] ..... H05B 3/00

[52] U.S. Cl. ..... 13/8

[58] Field of Search ..... 13/8, 23, 25, 31, 20

[56] References Cited

U.S. PATENT DOCUMENTS

| | | | |
|---|---|---|---|
| 2,252,052 | 8/1941 | Van Embden | 13/8 |
| 2,357,135 | 8/1944 | Roper-Lowe et al. | 13/8 X |
| 2,412,582 | 12/1946 | Hybinette et al. | 13/8 |

*Primary Examiner*—Roy N. Envall, Jr.

*Attorney, Agent, or Firm*—Larson, Taylor and Hinds

[57] ABSTRACT

A furnace is disclosed for extracting metals of relatively high volatility from compounds containing oxides of metals. The furnace provides uniform heating for the oxides in solid block form together with temperature and pressure control so that the dross does not melt. The furnace includes a lower portion having an insulated lining, an upper bell shaped portion joined to the lower portion to form an enclosed sealed chamber, the upper portion forming a condensation surface for metals, means for extracting heat from the upper portion, and means for controlling pressure within the sealed chamber. The improvement comprises an electrical heating conductor within the lower portion spaced apart from the insulated lining, the heating conductor having spaces to hold the compounds in a solid compressed form and transfer substantially uniform heat to the compounds in the spaces.

8 Claims, 4 Drawing Figures

EXTRACTION FURNACE

The present invention relates to extracting metals of relatively high volatility from compounds containing oxides of the metals. More particularly, the present invention relates to an electric furnace for extracting metals of relatively high volatility from their oxides by thermal reduction and subsequent recovery of the metals by condensation.

Reduction furnaces for the reduction of metal oxides wherein the oxides are first heated at reduced pressures so the metals vaporize followed by condensation of the metals on a cool surface are known. The type of metals that can be produced by these furnaces include the alkali metals, alkaline earth metals such as magnesium, and other metals of relatively high volatility. Examples of these types of devices are disclosed by Cooper in U.S. Pat. No. 2,429,668, Van Embden in U.S. Pat. No. 2,252,052 and Burnett in U.S. Pat. No. 2,650,085. Both Cooper and Van Embden show a device wherein the oxide is contained in a crucible or other similar shaped vessel, thus vaporization of the metal may only occur at the top of the vessel, and furthermore the heat supplied to the metal ore is from a source outside the vessel, specifically by electrical resistant heating elements or high frequency coils. The problem with both of these methods of heating is that not only does the metal oxide compounds become heated but also the lower portion of the furnace and the crucible containing the metal oxide also heats up.

Burnett shows an apparatus for the purification of calcium wherein heat is supplied to the calcium compounds within the chamber from a fused salt bath. None of these prior art patents appear to show the multiplicity of problems that arise when heating the oxides of these metals of relatively high volatility. In the first place the low thermal conductivity of most of these materials makes it difficult to obtain relatively rapid uniform heating of the mass of the metal oxides within the furnace This problem cannot be satisfactorily solved by using low volume charges because this requires frequent charging of the furnace. Frequent charging causes dissipation of thermal energy and time wasted.

It is a purpose of the present invention to provide an electric furnace for extracting metals of relatively high volatility from metal oxides which overcomes some of the problems present in existing extraction furnaces. The present invention provides an electric furnace wherein the mass of material to be reduced is formed into a solid compressed form having an electrical heating conductor therein, the conductor is then placed within a reduction chamber so that heat applied to the material to be reduced is applied only to the compressed form of the material and not to the chamber. Furthermore, a heating portion of the chamber itself has a conventional refractory lining and the compressed form of the material to be reduced is placed within this heating portion of the chamber with a space between the lining and the compressed form so that vaporization of the metal from the compressed form may occur on the top and sides of the form at the same time. This avoids rapid wear of the refractory linings which can occur if the lining is heated to the high temperatures necessary for the vaporization of the metals.

The present invention also provides a furnace for extracting metals of relatively high volatility from compounds containing oxides of these metals at a much higher extraction rate than previously known furnaces and one which allows a higher percentage of the metal to be extracted from the compounds. It also allows the dross or compounds which have been processed to be removed from the chamber while still hot and replace the dross with a fresh batch of compounds for reduction.

The present invention provides in an electric furnace for extracting metals of relatively high volatility from compounds containing oxides of the metals, the furnace including a first shell portion having an insulated lining, a second shell portion joined to the first shell portion to form an enclosed sealed chamber, the second shell portion forming a condensation surface for the metals, means for extracting heat from the second shell portion, means for controlling pressure within the sealed chamber, the improvement comprising an electrical heating conductor within the first shell portion spaced apart from the insulated lining, the heating conductor having spaces to hold the compounds in a solid compressed form and transfer substantially uniform heat to the compounds in the spaces.

In one embodiment of the present invention the heating conductor is in the form of a plurality of rings or a plurality of helical coils and the compounds fill spaces between these rings or coils. In another embodiment, the heating conductor comprises a hollow column structure of overlying rings with spaces there between to be filled with the compounds in a solid compressed form and may include additional heating elements within the hollow column structure. In one embodiment, the means for controlling pressure within the sealed chamber includes an exhaust pump and a pressure sensing device, and a filter may be provided to prevent vaporized metal from passing into the exhaust pump. In yet a further embodiment the furnace may have a plurality of condensation chambers connected to the enclosed sealed chamber, the condensation chambers being removable and replaced by other chambers.

In drawings which illustrate embodiments of the invention,

Figure 1:
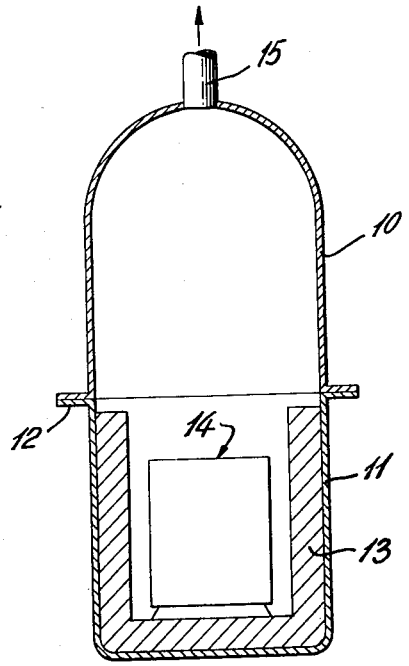
FIG. 1 is a diagrammatic cross sectional view through one embodiment of an electric furnace according to the present invention.
Figure 2:
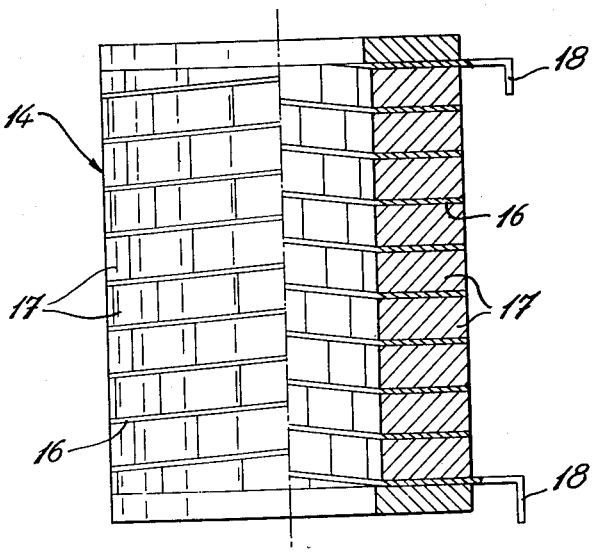
FIG. 2 is a side view, partly in cross section, of an electrical heating conductor together with the compounds in a solid compressed form shaped as a hollow column structure for insertion in the electric furnace shown in FIG. 1.

Referring now to FIGS. 1 and 2, a top bell shaped portion 10 and a lower cylindrical portion 11 define a substantially cylindrical chamber and are joined together in a detachable manner at flange 12. The join at flange 12 is provided with a suitable seal in order to provide an enclosed sealed chamber. The lower portion 11 is lined internally with refractory material 13 and constitutes the heating chamber or reduction chamber for allowing the metallic vapors to escape from the charge 14. The charge 14 rests in the lower portion 11, raised slightly above the lower surface of the lining 13, resting on a stand or other support as shown in FIG. 1 so that space remains between the side of the lining 13 and the charge 14 to allow the metallic vapors to escape from both the sides and top of the charge 14.

The top portion 10 has a surface condensation on the inside which is cooled by a cooling means to extract heat from the top portion 10. The top portion 10 is formed of a material of relatively high thermal conductivity. The inside surface of this top portion 10 forms the surface on which the metallic vapors are condensed, and thus the material of this upper shell portion 10 is of suitable strength in order to withstand the mechanical and thermal stresses to which it is subjected. A controlled reduced pressure is maintained in the sealed chamber by means of a suitable suction through conduit 15 connected to an exhaust pump (not shown). A pressure sensing device is included in the conduit 15 or in the enclosed chamber to control the pressure within that chamber. Furthermore, in another embodiment a filter is provided in the conduit 15 to ensure that the metallic vapors are not pulled into the exhaust pump.

The block or charge 14 for the furnace is preferably constructed as shown in FIG. 2 and is in the form of a hollow column structure comprising a plurality of electrical conductor elements 16 which in the embodiment shown are in a helical configuration with spaces 17 between the conductor elements 16 filled with compounds containing oxides of the metal to be extracted. These compounds are first mixed with the reducing agents and then compressed into the spaces 17 between the conductor elements 16 to form the block or charge 14. The conductor elements 16 are suitably connected at their terminals 18 to electrical connections provided within the furnace. The charge 14 is then heated by electrical resistance to the desired temperature. Temperature sensing devices (not shown) are fitted within the sealed chamber to ensure that the correct temperature is maintained and the conductor elements 16 ensure that the charge is heated uniformally throughout.

Whereas the conductor elements 16 shown in FIG. 2 are illustrated in helical form it will be apparent to those skilled in the art that these heating elements could be in the form of a plurality of rings and the compounds compacted or compressed between the rings. Furthermore, the heating conductor could comprise a plurality of individual conductor elements and the compounds compressed in spaces between these conductor elements. In another embodiment additional resistor heating conductors may be inserted within the column configuration shown in FIG. 2. The charge 14 of compacted compounds and conductor elements 16 is prepared outside the furnace, and the charge 14 is then positioned in the furnace, and connected to electrical connections within the furnace. After the metal has been extracted the top portion 10 is removed, the old charge 14 lifted out of the lower portion 11 while still hot and a new charge 14 inserted into the lower portion 11. In this manner the replacement of charges 14 takes a minimum of time and allows maximum use of the furnace. Furthermore, because the metal vapors are able to leave the charge from around the sides as well as on top, larger charges may be used in this furnace than used in other types of reduction furnaces.

In operation a charge 14 is first prepared by selecting the compounds to be mixed together, these compounds include the oxide of the metal to be extracted together with reduction agents. In the case of magnesium the ore may be calcined dolomite and the reduction agent may be ferrosilicon or aluminum. The compounds are mixed together in powder form and then compressed to fit into the spaces 17 between the helical conductor elements 16. The charge 14 is placed into the lower portion 11, ensuring that there is sufficient space all around the charge 14 between the sides of the charge 14 and the refractory lining 13. The top portion 10 is then placed on top of the lower portion 11 and the flange 12 connected to ensure there is a good seal, the exhaust pump is started to reduce the pressure within the sealed chamber to the required amount. The conductor elements 16 are heated and the heat passes from these elements 16 directly into the charge 17. As the temperature heats up the metal within the charge 14 vaporizes in the controlled pressure within the sealed chamber and the vapors rise upwards towards the suction conduit 15 where the vaporized metal contacts the cooled surface of the top portion 10 and condenses. This action takes place until all the metal has been extracted from the charge 14, the electrical power is then turned off and the exhaust pump stopped. The top portion 10 is removed and the old charge 14 taken out of the lower portion 11 while still hot. A new charge 14 is then placed within the lower portion 11. The metal that has condensed on the inner surface of the top portion 10 is scraped off and removed from further processing. These scrapings are generally pure condensed metal in crystalline form.

Figure 3:
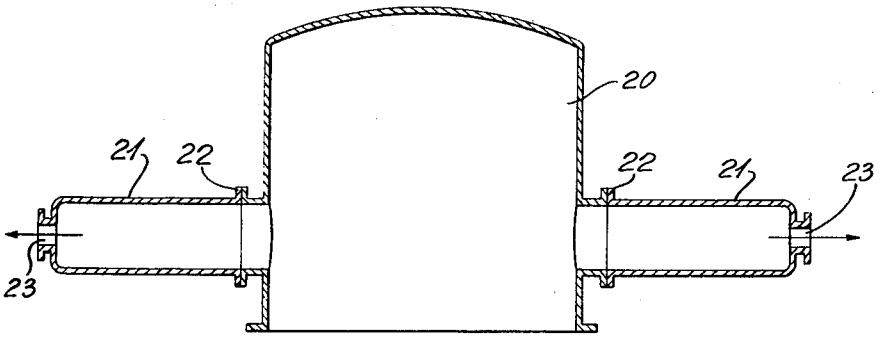
FIG. 3 is a diagrammatic cross sectional view through another embodiment of an electric furnace having a plurality of separate condensation chambers.
Figure 4:
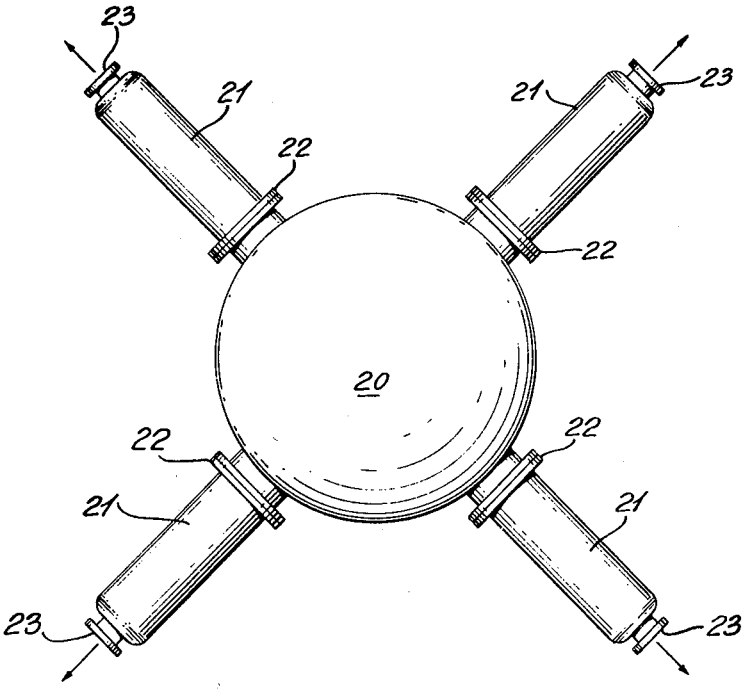
FIG. 4 is a top plan view of the electric furnace shown in FIG. 3.

Another embodiment of the top portion 20 is shown in FIGS. 3 and 4 wherein four separate condensation chambers 21 are located at right angles to each other around the top portion 20. Each of these separate condensation chambers 21 has a flange connection 22 where it joins to the top portion 20 and a suction conduit 23 at the extreme end of the chamber 21 so that the vaporized metal is pulled into each condensation chamber. The sides of the condensing chambers 21 are cooled thus the metal condenses on the inside surfaces of the chambers 21. When the reaction is over, the suction is turned off, and the chambers removed by undoing the flange connections 22. The chambers may be scraped of residual metal and replaced, or clean chambers may be immediately connected to the flange connections 22 and the suction turned on.

Various changes may be made to the electric furnace of the present invention without departing from the scope of this invention which is only limited by the claims.

The embodiments of the invention in which an exclusive property or privilege is claimed are defined as follows:

1. In an electric furnace for extracting metals of relatively high volatility from compounds containing oxides of the metals, the furnace including a lower portion having an insulated lining, an upper bell shaped portion joined to the lower portion to form an enclosed sealed chamber, the upper portion forming a condensation surface for the metals, means for extracting heat from the upper portion, means for controlling pressure within the sealed chamber, the improvement comprising an electrical heating conductor in the form of a plurality of rings within the lower portion spaced apart from the insulated lining, the heating conductor having spaces between the rings to hold the compounds in a solid compressed form and transfer substantially uniform heat to the compounds in the spaces.

2. The furnace according to claim 1 wherein the heating conductor is in the form of a plurality of helical coils and the compounds fill spaces between the coils.

3. The furnace according to claim 1 wherein the heating conductor comprises a plurality of individual heating elements and the compounds fill spaces between the heating elements.

4. The furnace according to claim 1 wherein the heating element comprises a hollow column structure of overlying rings with spaces there between to be filled with the compounds, and including additional heating elements within the hollow column structure.

5. The furnace according to claim 1 wherein the means for controlling pressure within the sealed chamber includes an exhaust pump and a pressure sensing device.

6. The furnace according to claim 1 including at least one side condensation chamber connected to the sealed chamber.

7. The furnace according to claim 1 wherein the upper portion is detachably connected to the lower portion and the electrical heating conductor is removable from the lower portion.

8. The furnace according to claim 1 including a filter to prevent vaporized metal from passing to the exhaust pump.

* * * * *